US006874449B2

(12) United States Patent
Haaga et al.

(10) Patent No.: US 6,874,449 B2
(45) Date of Patent: Apr. 5, 2005

(54) BLACK LIQUOR GUN

(75) Inventors: Kari Haaga, Tampere (FI); Seppo Puhtila, Kuopio (FI)

(73) Assignee: Kvaerner Power Oy, Tampere (FI)

( * ) Notice: Subject to any disclaimer, the term of this patent is extended or adjusted under 35 U.S.C. 154(b) by 0 days.

(21) Appl. No.: 10/697,187

(22) Filed: Oct. 30, 2003

(65) Prior Publication Data

US 2004/0123813 A1 Jul. 1, 2004

(30) Foreign Application Priority Data

Nov. 1, 2002 (FI) ..... 20021957

(51) Int. Cl.[7] ..... F28H 1/40
(52) U.S. Cl. ..... 122/7 R; 165/179
(58) Field of Search ..... 122/7 R, 407, 122/408.1, 428; 165/177, 179, 184

(56) References Cited

U.S. PATENT DOCUMENTS 3,779,318 A 12/1973 Livinston
3,795,475 A 3/1974 Hellstrom
4,416,422 A * 11/1983 Tinnis ..... 239/455
5,242,115 A * 9/1993 Brown ..... 239/414
5,327,945 A * 7/1994 Simpson et al. ..... 141/59
5,683,549 A * 11/1997 Stigsson ..... 162/30.1
5,762,005 A 6/1998 Parisi et al.
6,174,161 B1 1/2001 Slavejkov et al.
6,474,250 B1 * 11/2002 Penterson et al. ..... 110/261
6,578,529 B2 * 6/2003 Hytonen et al. ..... 122/7 R
2002/0043221 A1 4/2002 Hytonen et al.

FOREIGN PATENT DOCUMENTS

| | | |
|---|---|---|
| EP | 0 761 871 | 3/1997 |
| FI | 20002285 | 4/2002 |
| JP | 06 207393 | 7/1994 |

OTHER PUBLICATIONS

Patent Abstract of Japan of JP 06 207393 Dated Jul. 26, 1994.

* cited by examiner

*Primary Examiner*—Gregory Wilson
(74) *Attorney, Agent, or Firm*—Ladas & Parry LLP

(57) ABSTRACT

The invention relates to a black liquor gun (4) for feeding black liquor into a recovery boiler (1), comprising a nozzle (11) to be inserted into a furnace (2). Inside the black liquor gun (4) there is a flow guidance element (16), which provides an annular flow channel between the outer wall (14) and the flow guidance element (16).

19 Claims, 2 Drawing Sheets

BLACK LIQUOR GUN

FIELD OF THE INVENTION

The invention relates to a black liquor gun for feeding black liquor into a recovery boiler, the black liquor gun comprising a nozzle to be inserted through a wall of the recovery boiler into a furnace.

BACKGROUND OF THE INVENTION

Spent waste liquor, i.e. 'black liquor', produced in pulp manufacture is burnt in recovery boilers to recover the energy it contains as heat, on the one hand, and, on the other hand, to recover the chemicals it contains and to recycle them and thus to reduce the need for additional chemicals. Black liquor is fed into recovery boilers by black liquor guns, which convert continuous black liquor flow into droplet spray, which is sprayed into the furnace where it is burnt. A problem with known solutions is that the nozzle and joints of black liquor guns tend to burn. This is because, for instance, molten black liquor or burning coal accumulates on the black liquor gun as a result of flows occurring during combustion, which causes that the nozzle burns in course of time. In addition, oxygenous air flows through the mounting hole of the nozzle into the recovery boiler, which intensifies the burning of the material accumulated at the nozzle arm and causes that the nozzle arm becomes damaged more rapidly.

Significant factors during burning are poor cooling of the gun pipe and the above-mentioned accumulations on the outer and inner surfaces. As the nozzle of a black liquor gun may, in the worst case, become damaged and unusable even in one day and since one recovery boiler may include several black liquor guns, the repairing or replacement of the nozzles is an extensive and expensive service operation. At its worst, dozens of black liquor guns may burn and become damaged in one month. The burning and ensuing breaking of the black liquor gun cause significant extra costs, hinder the formation of an optimal droplet size and, in some cases, even cause danger, as black liquor, which is not in droplet format, flows directly to a char bed on the bottom of the recovery boiler.

Black liquor guns are serviced and their burning is prevented by different manual cleaning solutions, which remove material accumulated at the gun arms by means of different cleaning brushes and other devices. Some mechanical cleaning devices for black liquor guns have also been tested, but the results obtained were not satisfactory. Attempts have been made to clean black liquor guns and their mounting holes by blowing steam or air into the mounting hole, which has not considerably hindered the burning of the guns either.

BRIEF DESCRIPTION OF THE INVENTION

It is an object of the present invention to provide a black liquor gun which has a longer service life than the known solutions and which can weaken the combustion phenomenon, in particular.

The black liquor gun of the invention is characterized in that inside the black liquor gun, at least at the nozzle, there is a flow guidance element in the longitudinal direction of the nozzle and fastened to the black liquor gun, which flow guidance element reduces, in its location, the cross-sectional area of a black liquor flow channel inside the black liquor gun and provides an annular flow channel between the outer wall and the flow guidance element.

The essential idea of the invention is that at least inside the nozzle of the black liquor gun is mounted a longitudinal flow guidance element, which, on the one hand, reduces the cross-sectional area of the flow channel at least in the region of the nozzle, as the black liquor flow channel is formed into an annular channel between the flow guidance element and the nozzle, whereby the flow rate of black liquor in the black liquor gun increases at least in the region of the nozzle and the cooling effect improves. According to a preferred embodiment of the invention, the flow guidance element comprises parts, which control the black liquor flow and make the black liquor rotate inside the black liquor gun. These parts can be separate control blades, a separate spiral thread or the like placed on the surface of and around the flow guidance, or at least a part of the length of the flow guidance element can be twisted in a spiral manner in its longitudinal direction.

The invention provides the advantage that since the flow rate in the tubular channel increases, black liquor spends less time in the black liquor nozzle and, consequently, since the heat in the furnace of the boiler does not have so much time to affect the black liquor to be fed, it remains cooler and cools down the black liquor gun more effectively. Rotational movement also provides the advantage that since the black liquor gun heats up differently on each side, the rotation of black liquor makes the black liquor flow both past the hottest and the coolest parts of the surface. Thus, temperature differences will be balanced and with respect to current solutions, the temperature of the hottest parts is lower. The service life of black liquor guns is thus made substantially longer in a simple and easy manner.

BRIEF DESCRIPTION OF THE FIGURES

The invention will be described in greater detail in the attached drawings, in which FIG. 1 schematically shows a cross-section of a conventional recovery boiler, FIGS. 2*a* and 2*b* schematically show a structure of black liquor gun of the invention partly cut open from the side, and a cross-section thereof, FIGS. 3*a* and 3*b* schematically show another nozzle of the black liquor gun of the invention cut open from the side, and a cross-section thereof, FIGS. 4*a* to 4*e* schematically show examples on cross-sections of flow guidance elements of the black liquor gun according to the invention, and FIG. 5 schematically shows a side view of a flow guidance element of the black liquor gun according to the invention.

DETAILED DESCRIPTION OF THE INVENTION

Figure 1:
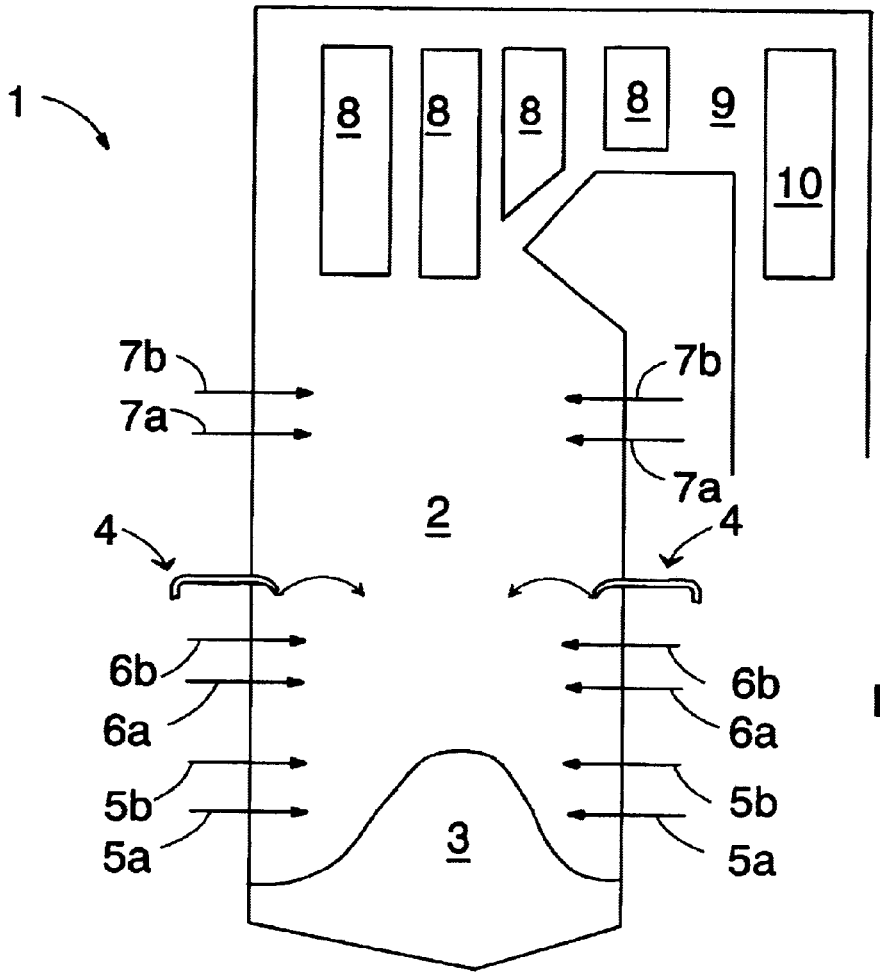

FIG. 1 shows a recovery boiler 1 known per se. The recovery boiler 1 is provided with a furnace 2, the lower part of which comprises a char bed 3. The char bed 3 is formed when black liquor is sprayed by black liquor guns 4 into the furnace of the recovery boiler, after which it falls as droplets to the bottom of the furnace 2 and forms a char bed in a manner known per se. The figure also shows primary nozzles 5*a* and 5*b*, secondary nozzles 6*a* and 6*b* and tertiary nozzles 7*a* and 7*b*, through which combustion air for black liquor combustion is fed into the recovery boiler in a manner known per se. As the figures show, the primary, secondary and tertiary nozzles can be arranged as two feeding levels one upon another at a suitable distance from each other.

Instead of them, another structural solution known per se and used in connection with air nozzles can be employed for feeding air into the recovery boiler. Since these various air feed solutions are fully known to a person skilled in the art and do not substantially relate to the present invention, it is by no means necessary to describe these different air feed alternatives in more detail.

When black liquor burns, combustion gases are formed inside the recovery boiler, which flow to the upper part of the recovery boiler. The upper part comprises heaters known per se, e.g. superheaters 8, which are heated by the hot combustion gases. Simultaneously they heat steam inside the heaters, after which the combustion gases are discharged from the recovery boiler into a flue gas duct 9. While flowing in the flue gas duct 9, they heat the heaters, i.e. economizers 10, in the flue gas duct as well as the water flowing therein. The structure and operation of all these parts are fully known to a person skilled in the art and, since they do not substantially relate to the actual invention, it is not necessary to explain them in greater detail herein.

Figure 2A:
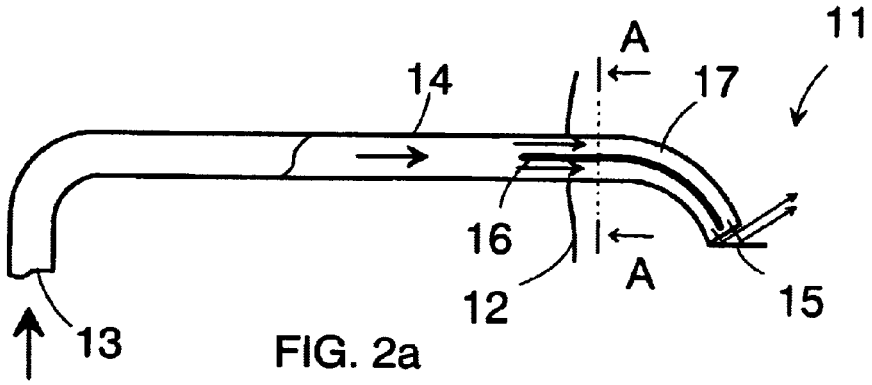

FIG. 2*a* schematically shows a structure of a black liquor gun of the invention from the side and partly cut open. The black liquor gun 4 comprises a nozzle 11, which extends through the outer wall of the recovery boiler, schematically illustrated with line 12, into the furnace of the recovery boiler. Black liquor is fed into the black liquor gun through a feed channel 13 and an arm 14, flowing further through the nozzle 11. The nozzle of the black liquor gun is usually provided with a decomposition plate 15, at which the spray of black liquor supplied by the nozzle 11 hits, scattering as droplet spray into the furnace and falling onto the char bed on the bottom of the recovery boiler where it burns. In the black liquor gun of the invention there is a flow guidance element 16 at least in the nozzle that is located inside of the furnace of the recovery boiler. The flow guidance element 16 is inside the black liquor gun so that a channel 17 with an annular cross-section is formed between the flow guidance element and the outer wall of the black liquor gun. As a result, the cross-sectional flow area of the black liquor gun decreases and the black liquor flow rate along the length of the flow guidance element 16 increases. Because of a higher flow rate, black liquor, which is heated due to the high temperature inside of the furnace of the recovery boiler, does not heat so much in the black liquor gun and the temperature differences will be balanced. Consequently, the temperature of the black liquor gun remains lower and burning of its material decreases. By using a flow guidance element 16 having a suitable shape, the black liquor is brought to rotation in the longitudinal direction of the black liquor gun in the annular channel 17, whereby the nozzle 11 of the black liquor gun 4 is cooled more evenly and the burning of the black liquor gun is decreased.

Figure 2B:
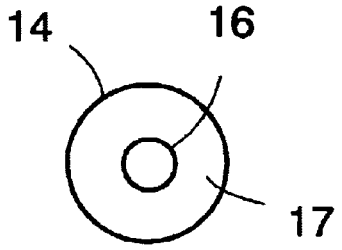

FIG. 2*b* schematically shows a cross-section of the black liquor gun of FIG. 2*a*, taken along the line A—A. As FIG. 2*b* shows, at the nozzle of the black liquor gun there is a flow guidance element 16, around which an annular flow channel 17 is formed. The cross-section and diameter of the flow guidance element 16 and thus the cross-section of the annular channel 17 can vary in different ways, as shown in the following figures, for instance.

Figure 3A:
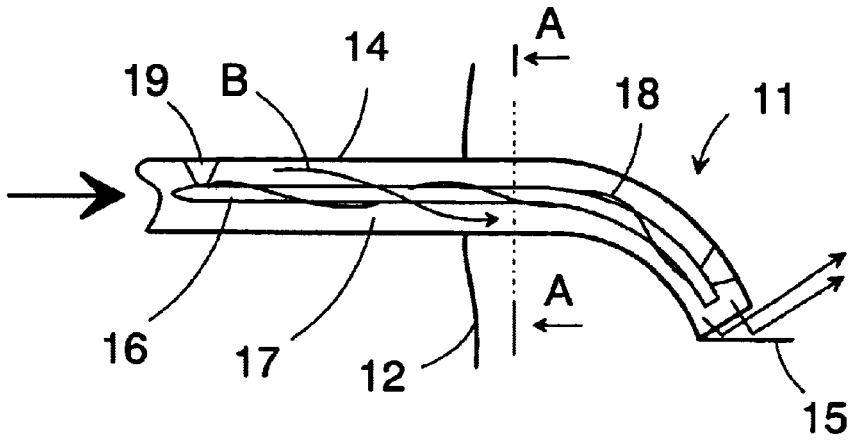
Figure 3B:
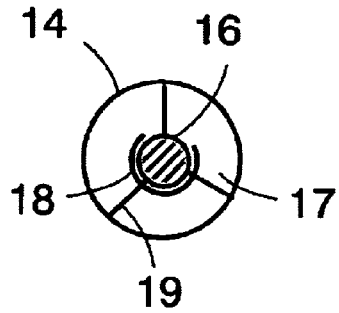

FIGS. 3*a* and 3*b* schematically show another embodiment of the black liquor gun of the invention cut open from the side of its nozzle, and a cross-section thereof.

FIG. 3*a* shows the black liquor guns nozzle 11, inside which there is a bar-like flow guidance element 16, which in this embodiment extends quite far outside the wall of the furnace of the recovery boiler. An annular channel is formed between the flow guidance element 16 and the outer wall 14 of the black liquor gun. A threadlike guide 18 is fastened by way of example around the flow guidance element 16 in a spiral manner. Due to the spiral thread 18, black liquor fed to the black liquor gun starts to rotate around the longitudinal axis of the black liquor gun as shown by arrow B. Since the upper surface of the nozzle of the black liquor gun faces the upper chamber of the boiler and easily accumulates a layer of burning material and the lower surface is more or less "protected" from direct heat radiation, the spiral flow of black liquor causes that the temperature differences between the upper and the lower side are balanced, which decreases the burning of the outer wall of the black liquor gun in the furnace of the recovery boiler. FIG. 3*b* schematically shows the cross-section of the embodiment according to FIG. 3*a* taken along the line A—A. It partly shows the spiral thread 18. FIG. 3*b* also shows that in this embodiment the flow guidance element 16 is made of a solid material. FIGS. 3*a* and 3*b* also show by way of example blade-like fastening means 19, by which the flow guidance element 16 is fastened to the outer wall of the black liquor gun, preferably on its inner surface, so that it remains in its place. There can be a different number of fastening elements 19 and, if necessary, their shape can vary. The fastening means 19 can also be shaped as blades in a way that they make the black liquor flow rotate.

Figure 4:
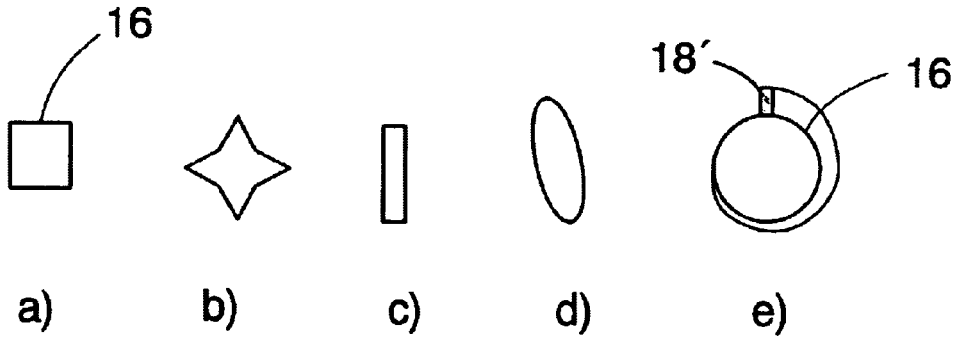
Figure 5:
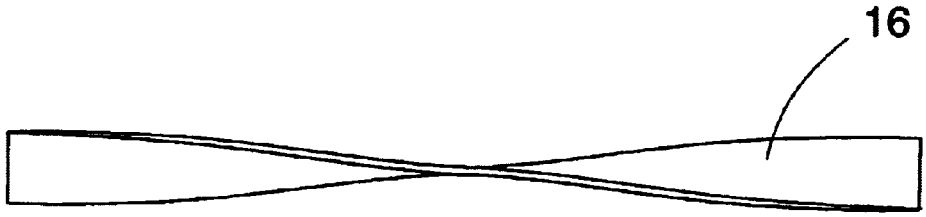

FIG. 4 shows other suitable cross-sections a to e of flow guidance elements of the black liquor gun according to the invention. The cross-section of a flow guidance element can be round, but also other cross-sections, such as angular, star like, flat and elliptical cross-sections, are possible. The flow guidance element can also be provided with separate guides, as shown in the embodiment e) of FIG. 4. In this case, the cross-section of the flow guidance element 16 is round, and a fairly low, flat flow guide 18' is fastened to the flow guidance element. This flow guide can be fastened according to FIGS. 3*a* and 3*b* to the flow guidance element 16 so that it is twisted around the flow guidance element 16 in a spiral manner, thus bringing the black liquor to rotation. As FIG. 4*e* shows, the height of the flow guide in the cross-direction can also vary. Similarly, in the embodiments a to d of FIG. 4, at least a part of the length of the flow guidance element can be twisted around its longitudinal axis to form a spiral or screw-like structure. FIG. 5 schematically shows an embodiment where a flat flow guidance element according to the embodiment c of FIG. 4 is twisted around its longitudinal axis to form a slightly spiral or screw-like flow guidance element. Although FIG. 5 shows a straight flow guidance element 16, it can naturally be shaped to curve according to the nozzle 11, as shown in FIGS. 2*a* and 3*a*.

The drawings and the related description are only intended to illustrate the idea of the invention. The details of the invention may vary within the claims. Thus, flow guidance elements can be either tubular or made of a solid material. Also, one or more separate flow guides can be twisted around the flow guidance element, the flow guides making the black liquor rotate around the longitudinal axis of the black liquor gun. With respect to the cross-sectional area of the black liquor gun, the cross-section of the flow guidance element can vary in different ways and according to the desired flow rate. As to the manufacturing technique, the most preferable flow guidance element has a substantially constant cross-section, whereby at least the end from which the black liquor flow is supplied is shaped as tapered to ease the flow.

What is claimed is:

1. A black liquor gun for feeding black liquor into a recovery boiler, the black liquor gun comprising a nozzle to be inserted through a wall of the recovery boiler into a furnace, characterized in that inside the black liquor gun, at least at the nozzle, there is a flow guidance element in the longitudinal direction of the nozzle and fastened to the black liquor gun, which flow guidance element reduces, in its location, the cross-sectional area of a black liquor flow channel inside the black liquor gun and provides an annular flow channel between the outer wall and the flow guidance element.

2. A black liquor gun as claimed in claim 1, wherein the flow guidance element has a substantially constant cross-section.

3. A black liquor gun as claimed in claim 2, wherein the flow guidance element has a cross-section diverging from a round shape and is twisted in the longitudinal direction around its longitudinal axis so that with respect to the outer wall of the black liquor gun, black liquor is brought to rotation at the flow guidance element.

4. A black liquor gun as claimed in claim 3, wherein a separate flow guide is mounted around at least a part of the length of the flow guidance element so that with respect to the outer wall of the black liquor gun, black liquor is brought to rotation at the flow guide.

5. A black liquor gun as claimed in claim 4, wherein as the black liquor gun is in its place, the flow guidance element extends outside the wall of the recovery boiler.

6. A black liquor gun as claimed in claim 3, wherein as the black liquor gun is in its place, the flow guidance element extends outside the wall of the recovery boiler.

7. A black liquor gun as claimed in claim 2, wherein a separate flow guide is mounted around at least a part of the length of the flow guidance element so that with respect to the outer wall of the black liquor gun, black liquor is brought to rotation at the flow guide.

8. A black liquor gun as claimed in claim 7, wherein as the black liquor gun is in its place, the flow guidance element extends outside the wall of the recovery boiler.

9. A black liquor gun as claimed in claim 2, wherein as the black liquor gun is in its place, the flow guidance element extends outside the wall of the recovery boiler.

10. A black liquor gun as claimed in claim 1, wherein the flow guidance element has a cross-section diverging from a round shape and is twisted in the longitudinal direction around its longitudinal axis so that with respect to the outer wall of the black liquor gun, black liquor is brought to rotation at the flow guidance element.

11. A black liquor gun as claimed in claim 10, wherein a separate flow guide is mounted around at least a part of the length of the flow guidance element so that with respect to the outer wall of the black liquor gun, black liquor is brought to rotation at the flow guide.

12. A black liquor gun as claimed in claim 11, wherein as the black liquor gun is in its place, the flow guidance element extends outside the wall of the recovery boiler.

13. A black liquor gun as claimed in claim 1, wherein a separate flow guide is mounted around at least a part of the length of the flow guidance element so that with respect to the outer wall of the black liquor gun, black liquor is brought to rotation at the flow guide.

14. A black liquor gun as claimed in claim 13, wherein as the black liquor gun is in its place, the flow guidance element extends outside the wall of the recovery boiler.

15. A black liquor gun as claimed in claim 1, wherein as the black liquor gun is in its place, the flow guidance element extends outside the wall of the recovery boiler.

16. A black liquor gun as claimed in claim 1, wherein the flow guidance element extends substantially to the end of the nozzle of the black liquor gun.

17. A black liquor gun as claimed in claim 1, wherein the flow guidance element is fastened to the inner surface of the outer wall of the black liquor gun by blade-like fastening means.

18. A black liquor gun as claimed in claim 17, wherein the longitudinal direction of the black liquor gun the blade-like fastening means are in an inclined position so that with respect to the outer wall of the black liquor gun, black liquor is brought to rotation at the fastening means.

19. A black liquor gun as claimed in claim 1, wherein as the black liquor gun is in its place, the flow guidance element extends outside the wall of the recovery boiler.

* * * * *